US005183422A

United States Patent [19]

Guiboche

[11] Patent Number: 5,183,422

[45] Date of Patent: Feb. 2, 1993

[54] PEDAL BOAT

[76] Inventor: Thomas Guiboche, 4-301 Marion Street, Winnipeg, Manitoba, Canada, R2H 0V1

[21] Appl. No.: 851,028

[22] Filed: Mar. 12, 1992

[51] Int. Cl.[5] ..... B63B 35/72

[52] U.S. Cl. ..... 440/26; 440/29; 114/345; 114/346

[58] Field of Search ..... 440/13, 14, 15, 21, 440/22, 26-31; 114/345, 346, 351; 441/40, 66, 67

[56] References Cited

U.S. PATENT DOCUMENTS

| | | |
|---|---|---|
| 2,681,459 | 6/1954 | Paquette . |
| 2,685,270 | 8/1954 | Pieraccioni Dit Pierac . |
| 3,809,003 | 5/1974 | Foldvari . |
| 3,895,597 | 7/1975 | Olevsky . |
| 3,954,079 | 5/1976 | Gof . |
| 3,987,747 | 10/1976 | Locher . |
| 4,020,782 | 5/1977 | Gleason . |
| 4,068,611 | 1/1978 | Leather . |
| 4,089,291 | 5/1978 | Craig . |
| 4,092,945 | 6/1978 | Anker et al. . |
| 4,353,703 | 10/1982 | d'Elloy . |
| 4,376,420 | 3/1983 | Fracarossi . |
| 4,511,338 | 4/1985 | Fanelli . |
| 4,648,846 | 3/1987 | Hsu . |
| 4,795,381 | 1/1989 | Willems . |
| 4,894,033 | 1/1990 | Chang . |

FOREIGN PATENT DOCUMENTS

| | | |
|---|---|---|
| 547450 | 10/1957 | Canada . |
| 606486 | 10/1960 | Canada . |
| 912922 | 10/1972 | Canada . |
| 1117379 | 2/1982 | Canada . |
| 1190099 | 7/1985 | Canada . |
| 1541332 | 10/1968 | France . |
| 602270 | 2/1960 | Italy . |

*Primary Examiner*—Joseph F. Peters, Jr.
*Assistant Examiner*—Stephen P. Avila
*Attorney, Agent, or Firm*—Adrian D. Battison; Stanley G. Ade; Murray E. Thrift

[57] ABSTRACT

A pedal boat for recreational use includes an inflatable ring on top of which is mounted a platform structure carrying a seat, pedals and a steering mechanism. The pedals drive a shaft mounted diametrically of the ring and carrying paddles. The steering action is effected by clutching the left or right paddles on the drive shaft.

6 Claims, 6 Drawing Sheets

PEDAL BOAT

FIELD OF THE INVENTION

This invention relates to the field of boats and more particularly to pedal operated boats.

BACKGROUND OF THE INVENTION

Paddle driven boats are well known. U.S. Pat. No. 2,253,936 discloses an arrangement in which an inflatable boat is powered by two-hand crank operating paddles on each side of the device.

U.S. Pat. No. 2,752,617 discloses an inflated support arrangement with a single propeller driven by hand crank arrangement at the front of the device.

In neither of the above patents is there disclosed an inflatable craft powered by a pedal and paddle assembly, with a means for steering the craft, and a means for seating of the operator. No other prior devices provide for a stable craft, in which the operator sits comfortably thereon and easily operates both of the pedals and steering components of the craft. Prior devices lack stability and have been constructed in a very complex manner.

SUMMARY OF THE INVENTION

An object of the present invention is to provide a stable vessel, readily portable, simple in construction and easy to operate.

The present invention therefore provides for a vehicle comprising an inflatable annular tube, with an opening therethrough, seating means for receiving an occupant seated thereon, and means for mounting the seating means on the tube comprising a rigid platform, said seating means positioned to allow the operator to operate a set of pedals with his feet and means for steering with at least one hand, said pedals attached to the said platform and connected to at least one transverse axle located below the platform end within the said the opening, said axle having disengageable paddles attached at its other ends thereof, said paddles connected to the said means for steering.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
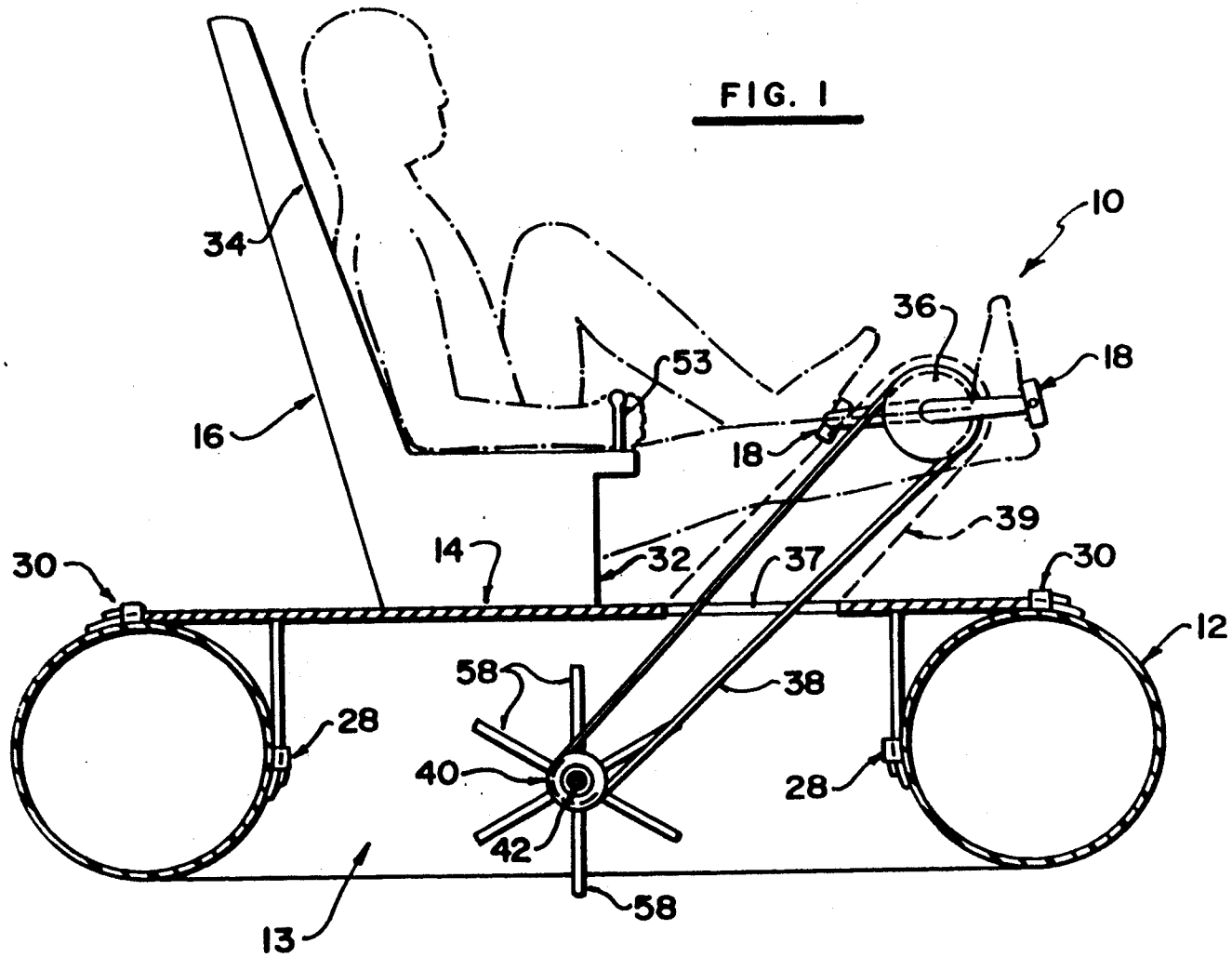
FIG. 1 is a side view of the first embodiment.
Figure 2:
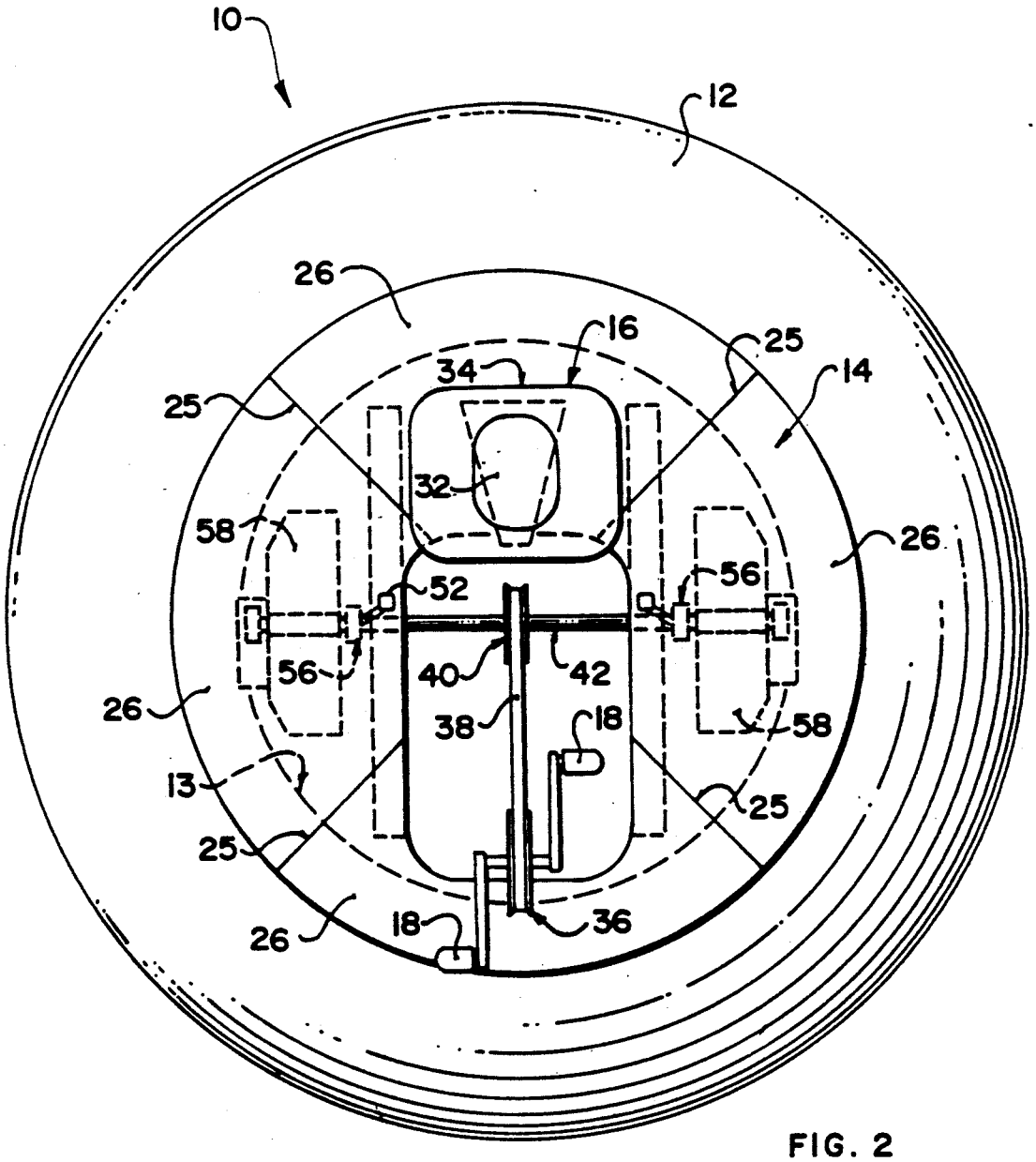
FIG. 2 is a top view of the first embodiment.
Figure 3:
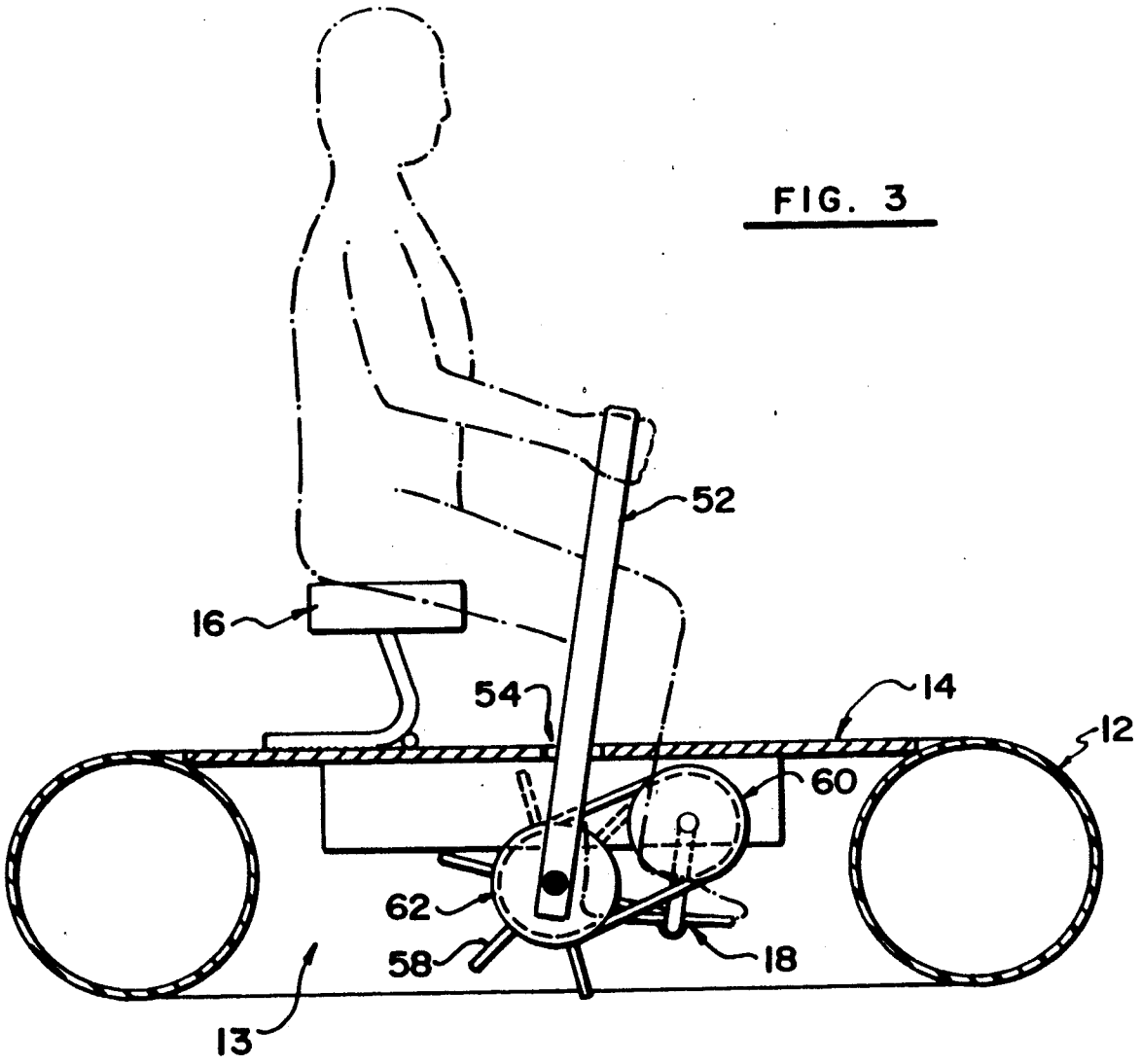
FIG. 3 is a side view of the second embodiment.

A pedal boat is shown generally at 10. The preferred embodiment of the invention is comprised of an inflated annular tube 12, with an opening 13 therethrough. The tube has attached thereon a rigid platform 14. The platform is comprised of four separate detachable pieces 26 that attach to each other at interconnecting positions 25 to form the platform. The pieces 26 are interlocking pieces that fit loosely together at interconnecting positions 25 prior to the tube inflation.

The platform pieces 26 are also connected to the tube at position 28 on the inner radius of the tube 12 and at position 30 on the top of the tube 12.

The connecting means at 25, 28 and 30 are all comprised of engaging members that fit loosely together prior to the inflation of the tube. As the tube is inflated the connecting pieces at 25, 28 and 30 all become increasingly secured. The disengagement of the pieces from each other and the tube may only occur when the tube is deflated.

There is attached to the platform a seat 16. The seat 16 is positioned near the outer edge of the platform and facing towards the center of the platform. In the first embodiment, the seat has a cushion portion 32 and a backrest 34. The seat is positioned so that the person seated on it will be in a recumbent position. Directly opposite the platform from the front of the seat cushion 32 are pedals 18. The pedals are slightly elevated from the platform in the preferred embodiment and are attached to a wheel 36 between the two pedals 18. The wheel 36 is connected by a belt 38 to a second wheel 40. The second wheel 40 is positioned centrally under the platform. The belt from wheel 36 attaches through an opening 37 on the platform to the wheel 40. An attached guard 39 supports the pedal assembly on the platform. The wheel 40 is aligned in the same direction as the wheel 36 and is positioned under the platform generally below the seat on the platform.

There is extending through the center of the wheel 40 a transverse axle shaft 42 that extends the diameter of the opening 13 in the tube. On the axle shaft 42 there are two engageable sleeves 44, one at each end of the shaft 42. The sleeves 44 engage with flanges 46 on the axle shaft. The sleeves 44 wrap around the axle shaft 42 and are kept in place at both ends by a coiled spring 48 wound around the axle shaft 42, between the sleeve 44 and a hub 50 at each end of the shaft. Each sleeve is located on the axle below the platform and on opposite sides of the opening 13. The spring 48 is not attached to the axle 42 but rather is slideably associated thereon. The hub 50 is attached to the inner radial surface of the tube.

Within the sleeve 44 there are slots 45 that engage at the flanges 46 on the axle shaft. Attached to each sleeve 44 are paddles 58. The paddles 58 are attached to the sleeve 44 that wraps around the axle shaft 42. The web of the paddle 58 extends radially outward from the sleeve 44 carried on shaft 42.

Adjacent each side of the seat 16 are elongate rods 52 that extend from a position adjacent to the seat 16 downwardly through an opening 54 on the platform 14 to a position where they align with the axle shaft 42. There is attached at the lower end of the elongate rod 52 a member 56 that is positioned immediately adjacent the sleeve 44. The elongate rod 52 is movable within the opening 54, and the attached member 56, at the bottom of the elongate rod 52, aligns with and abuts the sleeve 44 on the axle shaft 42. At the upper end of rod 52 is a handle 53 and attached Bowden cable positioned thereon to enable the operator to manipulate the rod 52.

Once the platform 14 is attached to the connection positions 28 and 30 on the tube 12, the tube is inflated. The inflation of the tube results in the secured interlocking of the platform pieces 26 with each other and the platform pieces 26 with the tube 12 at 28 and 30 to form a rigid platform 14. In order to take apart the craft, the tube 12 must first be deflated.

The axle shaft 42 is attached at each end to hub 50, and hub 50 is attached to the inner radial surface of the tube 12. The hub and axle arrangement is also attached to the tube prior to the tube inflation, and is securely attached to the tube as the tube inflates.

In operation, an operator sits on the seat 16. His back is positioned against the back of the seat 34 and his legs extend to engage the foot pedals 18. In the first embodiment the pedals 18 are slightly elevated so that the operator is seated in a recumbent position, and his legs are positioned above his waist while engaging the pedals.

The operator holds the handle 53 in each hand, at the top of each of the elongate rods 52. By moving the handles, the attached Bowden cables 55 move the rods 52 and act to steer the craft. By moving the handles towards or away from his body, the operator is able to steer or turn the craft in a direction he desires.

The rod movement causes the attached member 56 at the bottom end of the elongate rod 52 to abut the sleeve 44 and move the sleeve 44 towards the outside of the shaft 42. The displacement of the sleeve 44 along the shaft results in a disengagement of the axle shaft flanges 46 from the slots 45 in the sleeve 44. As a result of this disengagement, the paddles stop as the sleeve 44 to which the paddles are attached, no longer rotates about the shaft 42. As the flanges 46 no longer engage the cooperating slots 45, the shaft continues to rotate as the operator pedals, however the paddles on the disengaged sleeve do not move.

The sleeve 44 is allowed to displace along the shaft 42, as it is spring loaded. The sleeve 44 causes the coiled spring 48 to collapse when the attached member 56 abuts the sleeve 44, and the sleeve moves back along the shaft 42 in to an engaged position when the member 56 is removed from the sleeve 44 by the operator of the craft. The position of the handles above the steering rod on either side of the operator determines the direction of the craft. The stopping of one paddle while the opposite one is moving, results in the craft moving in a direction rotating about the stopped paddle. If the right paddle is disengaged, the left paddle movement causes the boat to veer right. At the operator's hand level, the right steering rod 52 pulled toward the operator results in the boat turning to the right. Re-engaging the right paddle, along with the left, results in the boat continuing along in a straight path.

As the craft is an annular tube, the steering mechanism is quite effective. A 360° rotation of the craft is performed quickly and easily. The pedal to axle shaft arrangement may be such that the pedals are allowed to move in both the forward and backward directions. This would allow a reversal of the paddle rotation, which would thus result in an enhanced mobility of the craft. The direction of the pedaling, along with the above steering mechanism, will result in an increased maneuverability of the vessel.

A second embodiment of the above includes a raised seating arrangement, so that the operator is in a seated position with feet on pedals and legs below his waist when engaging the pedals, and not in a recumbent position as described in the first embodiment. The pedaling action is essentially the same, however the power for the craft comes mainly from the legs.

The position of the seating arrangement in the above first embodiment allows the operator to use a variety of muscle groups rather than just his legs. As the back is against the seat, the power for pedaling can come from the back and shoulder muscles, as well as the leg muscles.

Figure 4:
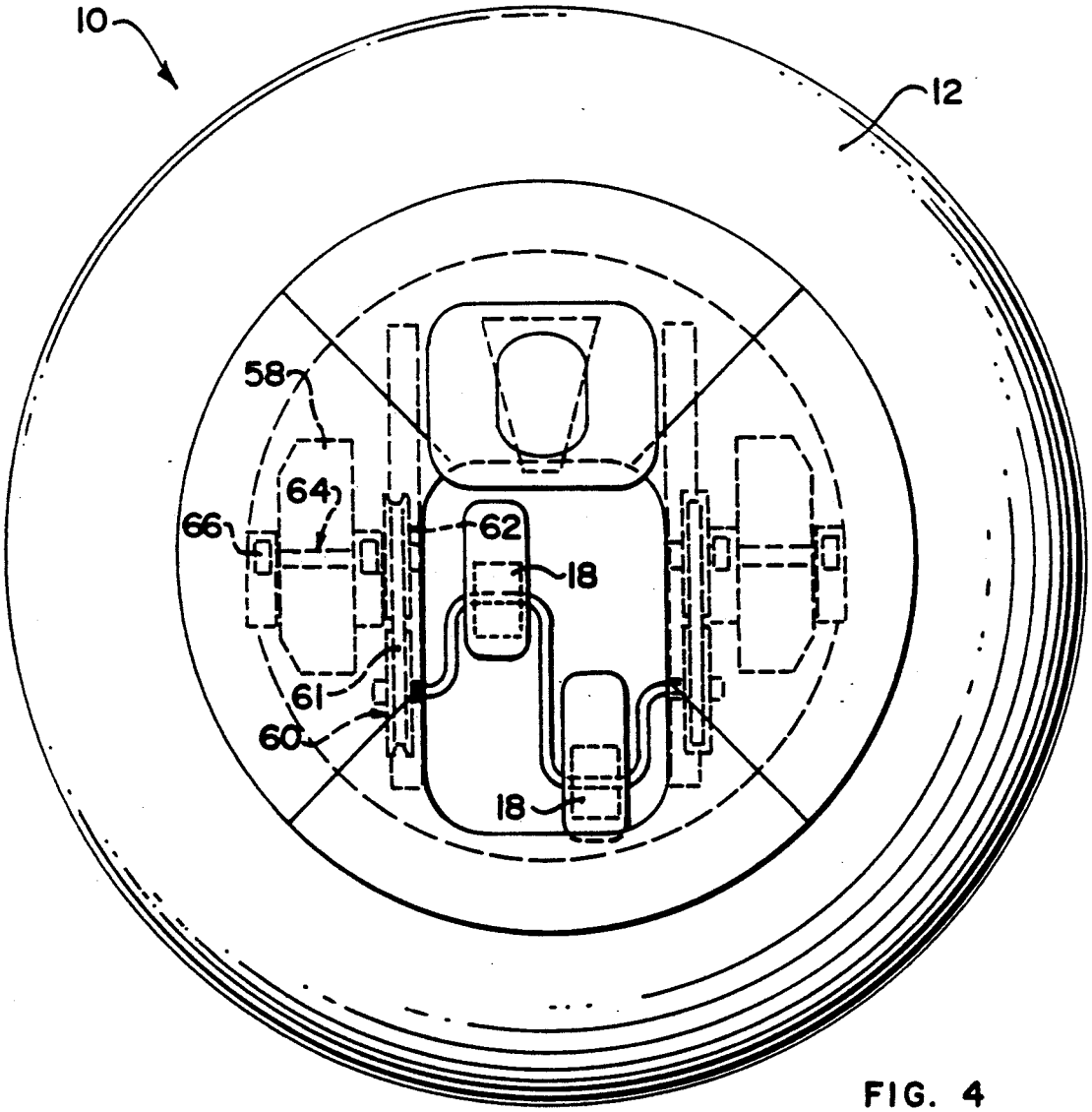
FIG. 4 is a top view of the second embodiment.
Figure 5:
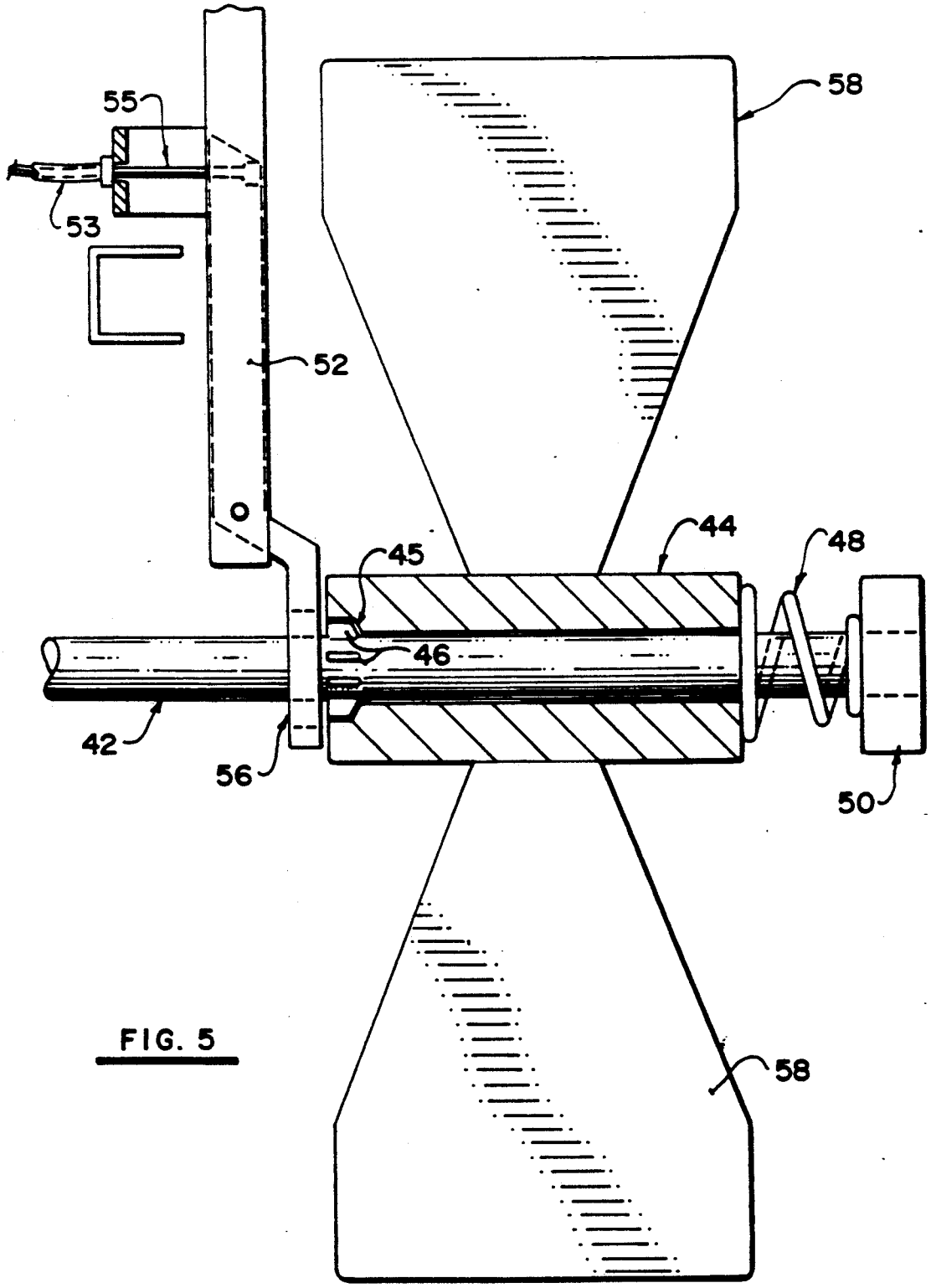
FIG. 5 is a side view of the axle shaft/paddle assembly.
Figure 6:
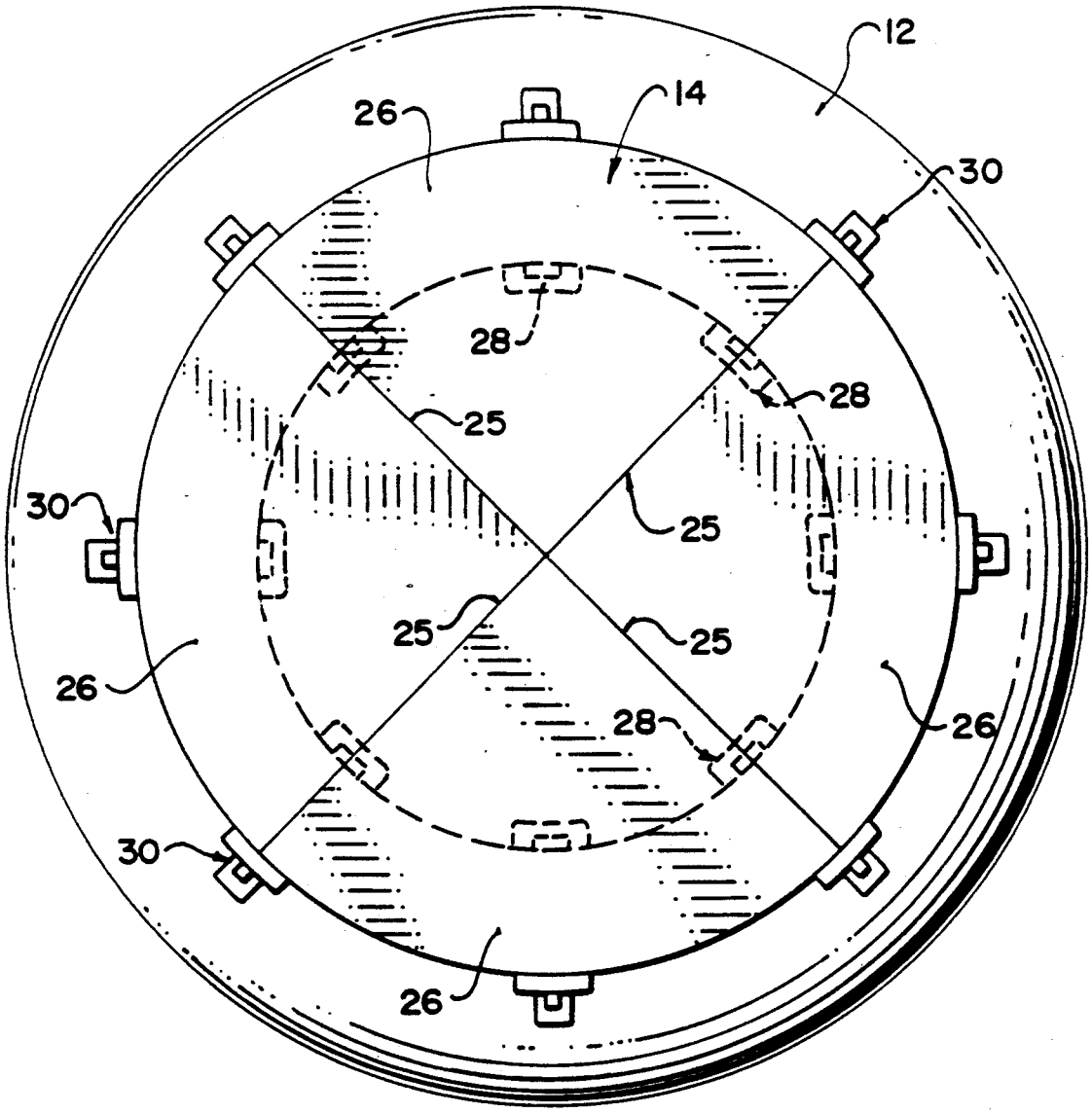
FIG. 6 is a top view of either embodiment illustrating the platform attachment to the annular tube.

Other modifications may be made to a design that do not affect the spirit and scope of the invention. A second embodiment of the invention shown in FIG. 4 has a double wheel system attaching to the paddles 58. To each wheel 60 is attached a belt and each belt 61 in turn attaches to a second wheel 62 positioned on each side of the operator and attached to separate axle shafts 64 that essentially operate as the transverse shaft 42 in FIG. 1 however the removal of the central part of the axle shaft results in the lowering of the seating arrangement as described above. The axle shafts extend from a point below the platform just adjacent the seating arrangement to the hub 66 at the end of each shaft. As there is no transverse axle shaft, the lower seat results in a lower center of gravity and added stability to the craft. The mechanics of the steering and propulsion remain essentially the same as in the first embodiment.

A further alternative (not shown) has a single handle on either side of the vehicle, rather than the two handles 53 as described above. A single handle would thus allow the operator to have a free hand while operating the vehicle with his other hand.

An alternative embodiment of the present invention (not shown) comprises the same device as described with the pedals and paddles removed. The craft is used in conjunction with the canape or cover and used as a platform upon which to sit. The device may be used for ice fishing in the winter time. After a hole is chopped through the ice and the tube placed over the hole so that the opening 13 of the tube is aligned with the hole in the ice, a fishing line could be extended through the opening 37 on the platform by the removal of the pedal guard 39. The fishing line is then extended through the opening of the tube 13 and into the hole in the ice.

It is also possible to just let the craft float in a swimming pool without its paddles or pedals, again with or without a cover to keep the bugs, or sun, off of the operator.

Since various modifications can be made in my invention as hereinabove described, and many apparently widely different embodiments of same made within the spirit and scope, it is intended that all matter contained in the accompanying specification shall be interpreted as illustrative only and not in a limiting sense.

I claim:

1. A boat comprising an inflatable annular tube, with a central opening therethrough, a rigid platform mounted on the tube so as to bridge the central opening, seating means mounted on the platform for receiving an occupant seated thereon, a set of pedals mounted on the platform, hand actuatable lever means mounted on the platform for steering the boat, said seating means positioned to allow the occupant to operate said set of pedals with the feet of the occupant and said means for steering with at least one hand, a transverse axle means located below the platform and within the said opening, means mounting the axle means for rotation about an axis transverse to the opening, means for communicating driving rotation from the set of pedals to the axle means, a first and a second paddle member mounted for rotation about said axis each mounted adjacent a respective one of two opposed ends of the axle means, first and second clutch means each actuatable to communicate drive from said axle means to a respective one of said paddle members, and means connecting said means for steering to each of said clutch means to provide a steering action by selectively driving said respective paddle member.

2. A boat according to claim 1 in which the rigid platform comprises a plurality of separate individually attachable pieces, each of said pieces having means thereon for attachment to the other pieces to form a substantially circular platform and means for interconnecting with the annular tube to mount the circular platform onto the annular tube to substantially close said central opening.

3. A boat according to claim 2 in which each of the piece is substantially segmental in shape having two sides diverging from a central apex and an arcuate third side remote from the apex, the two sides having means thereon for attachment to a next adjacent one of the pieces and the arcuate side having means thereon for attachment to the tube.

4. A boat according to claim 3 wherein the platform is arranged to lie substantially in a top plane of the tube and wherein each piece includes a downwardly depending attachment member for engaging the tube substantially within the central opening.

5. A boat comprising an inflatable annular tube having a central opening therethrough, a rigid platform mounted on the tube so as to bridge the central opening, seating means mounted on the platform for receiving an occupant seated thereon, a set of pedals mounted on the platform, said seating means being positioned to allow the occupant to operate said set of pedals with the feet of the occupant, transverse axle means located below the platform and within said opening, the axle means carrying paddle means rotatable about a longitudinal axis of the axle means for causing propulsion of the boat, the rigid platform comprising a plurality of separate detachable pieces, each piece being substantially segmental in shape so as to define two straight sides diverging from an apex at a center of the opening and an arcuate third side, each piece having attachment means on the sides thereof for attachment to next adjacent pieces and attachment means on the arcuate side for engagement with the tube.

6. A boat according to claim 5 wherein the platform is arranged to lie substantially in a top plane of the tube and wherein each piece includes a downwardly depending attachment member for engaging the tube substantially within the central opening.

* * * * *